US006050122A

United States Patent [19]

Fabris

[11] Patent Number: 6,050,122

[45] Date of Patent: Apr. 18, 2000

[54] SLITTER FOR THE PRODUCTION OF MULTIPLE SECTIONS

[76] Inventor: Mario Fabris, 188 North Service Road, Grimsby, Canada, L3M 4E8

[21] Appl. No.: 09/275,111

[22] Filed: Mar. 24, 1999

[51] Int. Cl.[7] ..... B21B 1/00

[52] U.S. Cl. ..... 72/204

[58] Field of Search ..... 72/203, 204

[56] References Cited

U.S. PATENT DOCUMENTS 885,508 4/1908 McKee ..... 72/204

FOREIGN PATENT DOCUMENTS 59-24502 2/1984 Japan ..... 72/204
60-130401 7/1985 Japan ..... 72/204
61-229402 10/1986 Japan ..... 72/204

*Primary Examiner*—Rodney A. Butler
*Attorney, Agent, or Firm*—Edward H Oldham

[57] ABSTRACT

A slitter for a steel mill comprising a pair of spaced rollers having a predetermined surface configurations. A deeply grooved steel workpiece is passed through the gap in the spaced rollers and each section of the workpiece (between the grooves) is twisted through a small angle. Because each section is twisted in the same direction, the workpiece fractures along each groove in the workpiece.

5 Claims, 2 Drawing Sheets

SLITTER FOR THE PRODUCTION OF MULTIPLE SECTIONS

FIELD OF THE INVENTION

This invention relates to methods and apparatus for producing multiple sections from a hot steel billet or bar by progressive rolling passes in a steel mill. The general process of producing multiple separated elemental strips of steel is referred to as slitting.

BACKGROUND OF THE INVENTION

Reduction of steel billets or blooms in a steel mill to a finished product (e.g. rod or wire) is a time consuming and expensive operation involving the use of costly equipment.

Typically, a billet is reduced to a work product which becomes longer and longer with each pass. Because of the elongation involved in the reduction of the billet, the bar or rod may be cropped into smaller lengths which can be processed individually without requiring the whole billet work product to pass through and be stored on coiling apparatus at either side of the reduction rollers.

In order to reduce the quantity of steel product which must be passed through the reduction stages of a reducing rolling mill, operators have sought methods of slitting a reduced billet into a plurality of parallel sections after a predetermined number of passes (usually 10) in a primary reduction process. The work product is slit into two (usually) pieces which may be processed in a parallel finishing operation, as opposed to causing the work product to be completely finished in one continuous piece.

Typically, a well known prior art method of reduction employing a slitting operation in general use, at the present time, requires that a steel billet be reduced to a "fluted square" in a predetermined number of passes (usually 10) in a primary reduction mill.

The fluted square is rolled into what is generally referred to as a "dog bone" shape which is reduced to a "peanut" shape in two rolling steps.

The peanut shape of the steel workpiece lends itself to slitting because of the narrow web holding the two substantially circular sections of the peanut together.

Thus, the single peanut is slit with two separate strands (or sections) which may be processed in a parallel reducing operation to yield a finished product.

Most steel mill operators agree that the use of a slitting operation is more efficient than employing rolling reduction to achieve the same reduction in cross sectional area of the workpiece.

But slitting, by means of the prior art, is not without ensuing problems. The process, just described, produces only two workpieces which may be processed by a parallel processing operation. If an attempt is made to increase the number of sections of separated parallel workpieces, problems may arise because of the adverse material flow in forming the hot steel workpiece. The adverse flow results from forcing the hot steel product to flow in directions other than the direction of rolling in order to produce the complex shape of the hot steel workpiece which is to be subsequently slit into four or five parallel sections. Problems also arise due to uneven temperature distribution in the resulting slitted workpieces which result in difficulty in subsequent rolling required to achieve the final shape in the finished product, resulting in the production of an inferior product.

The "dog bone"-"peanut" slitting operation itself requires moving the hot steel product through four rolling stands and (usually) eight separate mill guides, to successfully produce the separated product sections. A malfunction in any one of the eight guides may lead to an interruption in the production of the slitted workpiece. Those familiar with the process are well aware of the hostile nature of the environment in which these guiding devices must operate.

Methods other than the "dog bone"-"peanut" production procedures have been employed by steel mill operators with varying degrees of success.

At times, when the plurality of sections of different cross sectional area are formed in a workpiece prior to the actual slitting operation, the acceleration forces to which the various sections of the workpiece are subjected are sufficient to cause premature fracture of the web holding the sections together, or if the workpiece remains intact, it tends to undergo severe curvature as it exits from the rolling mill. Problems, arising from such operations, result in lower quality finished product and at times the generation of scrap.

Slitting with wedge shaped cutters may also produce an end product having undesirable camber (see U.S. Pat. No. 4,370,910) which may yield a section which is subsequently difficult to roll. As well, some rolling processes cause an adverse material flow in the web of the section being slit in a directions other than in the direction of rolling. This undesirable material flow in the web yields a product the physical characteristics of which may be somewhat impaired.

At other times, steel mill operators have developed sophisticated methods of twisting the hot steel product before it is passed into the slitter-rollers. The twisting of a hot steel product requires the use of equipment, which in prior art installations, is subject to wear and may be prone to failure because of the nature of the operation being carried out on the product passing through the mill. At other times, the slitting operation requires the addition of other rolling accessories to "straighten" the product.

SUMMARY OF THE INVENTION

The process of this invention begins at the conclusion of the reduction of the billet or bar in ten reduction stages. Passage through the eleventh stand produces a bar having a rectangular cross section. The rectangular cross section will have dimensions which vary according to the number of strands being produced. For the production of 4 strands, the width may be about 10–11 times the height of the bar. Other dimensional configurations will be required for the production of a different number of strands.

Stand number twelve produces a bar having slightly greater width than it had upon entrance because a series of longitudinal opposing grooves have been rolled into the bar during passage through millstand twelve.

Passage through millstand 13 produces a bar which now has a plurality of divisions extending in the direction of rolling, so that each section is more isolated from its adjacent section by a deep groove, but as yet the sections remained joined by a narrow web.

Millstand 14 produces separation of the sections by producing a "twist" into each section, so that each section undergoes a slight twist in the same direction of rotation during passage through this millstand. The adjacent edges of each section are displaced away from each other by the twisting action induced into each section by fluting formed in the rolls of the fourteenth roll stand.

The separated sections, which have an elongated oval shape, are allowed to twist through a right angle before entering the fifteenth roll stand where a round or other desired cross section is produced.

The separation of the bar which was produced at the eleventh millstand may be accomplished by applicant's apparatus to produce as many as six separated webs of the hot steel product.

PERTINENT PRIOR ART

U.S. Pat. No. 281,184 Jul. 10, 1983

This patent divides a billet into a series of sections in opposite directions from a common central plane by progressive rolling steps. When the adjacent sections are displaced sufficiently so that each section is joined to its adjacent sections by a small longitudinal web, the billet sections are pushed back into the central plane to break the longitudinal webs between adjacent sections to produce the separated sections.

U.S. Pat. No. 885,508 Apr. 21, 1908

This patent subjects a hot steel billet to a number of passes in a mill in order to produce deep parallel channels in the billet. The sections of the billet which, lying within the channels, are then subjected to different rates of reduction during a rolling process to produce differing exit velocities between the adjacent sections so as to fracture the web existing between the sections formed by the channels to produce separated sections between the previously joined channels.

U.S. Pat. No. 4,204,416

By passing a billet between opposing rollers having V shaped rings protruding from the roller surface, this patent describes a process for reducing a billet to a number of joined sections each having rectangular cross section but where the sides of the sections are formed so as to make an angle of about 45° with the rolling axis due to the V shaped rollers. By suitable reduction, the various rectangularly shaped sections are shifted to reduce the web between adjacent sections and separate the sections.

U.S. Pat. No. 4,357,819

This patent describes the method of producing three separate sections by a modified "dog-bone"-"peanut" rolling sequence.

U.S. Pat. No. 5,626,044 May 6, 1997

This patent describes a method of producing sections of unequal cross section prior to slitting of the sections. Because some of the sections (i.e. outermost) must travel increased distances after separation, these sections tend to be stretched somewhat. These sections (which must travel the greatest distance after separation) have been rolled so that they have slightly larger cross sectional area. These sections are subjected to a greater tension force and tend to be reduced in cross section during the stretching procedure. The separated sections may then be simultaneously rolled in the same mill stand after separation without having greatly differing exit velocities.

DESCRIPTION OF THE PREFERRED EMBODIMENT

Figure 1:
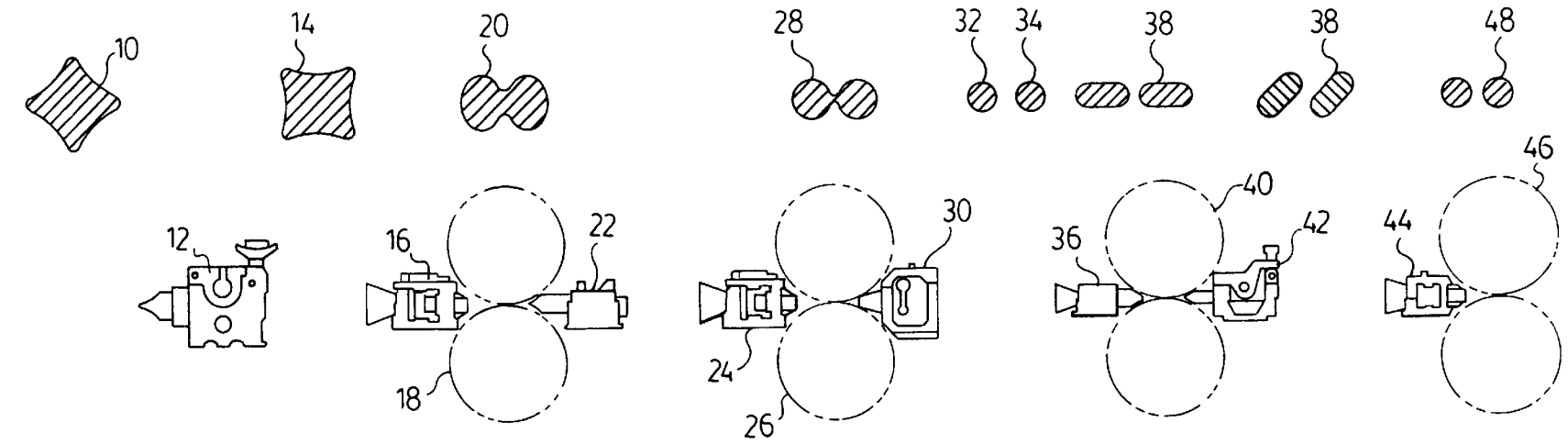
FIG. 1. (PRIOR ART)
FIG. 1 shows the classical steel mill apparatus used for slitting a bloom or billet to a finished circular cross section using techniques of the prior art.

Referring now to FIG. 1 which shows a sequential rolling process for reducing a "fluted square" to a pair of rods or wires having a circular cross section in four reducing rolling operations. The "fluted square" steel billet 10, which has a classical shape, is shown having exited from millstand #12 in a modern billet reducing mill. The member 10 is twisted through an angle of about 45° as it passes through a twister delivery guide 12 to take the orientation shown at 14. The twisted "fluted square" member 14 which exits from the twister guide 12 with new orientation is now passed through a roller entry guide such as 16 which maintains the correct orientation of the member 14 for subsequent passage through the thirteenth millstand 18 which produces "dog-bone" shaped member 20. Dog-bone shaped member 20 subsequently passes through a static delivery guide 22 which assures that dog bone 20 does not exit from millstand 18 improperly. After passage through static guide 22, the dog bone 20 enters entry guide 24 which traditionally is a four roller entry guide where dog bone 20 is passed into the fourteenth millstand 26. Here a "peanut" member 28 emerges from millstand 26. At this stage, the two substantially circular cross sectioned members joined together by a very narrow web comprising the "peanut" 28 are passed through slitter guide 30 to fracture the small connecting web and produce two separated substantially circular sections 32 and 34. The individual members 32 and 34 are separated and each member is passed through a static entry guide such as 36.

Thus, each of the separated sections 32 and 34, are reduced into an oval cross section in member 38 in the fifteenth millstand 40. Each oval member 38 passes through a twister delivery guide 42 which twists the member 38 through 90°. The twisted member 38 is fed into a four roller entry guide 44 which passes oval member into the sixteenth millstand 46.

At millstand 46 the previous oval shaped cross section member 38 becomes a round rod or wire 48.

This process involves four millstands and eight mill guides of which two of the guides are "twister" guides.

The disadvantages of such prior art slitting operations are many and varied. The completed product (wire or rod) requires 16 millstands to produce two strands of the final product.

Two of the guides required for the slitting operation are "twister" guides which are subject to increased wear and maintenance in the hostile environment in which they perform their function.

This traditional method of slitting can successfully produce only 2 separated sections. If more separations are attempted, the separated sections are difficult to roll because of the lack of homogeneity in the temperature of the separated sections. The prior art shows such problems (see U.S. Pat. No. 4,370,910).

Figure 2:
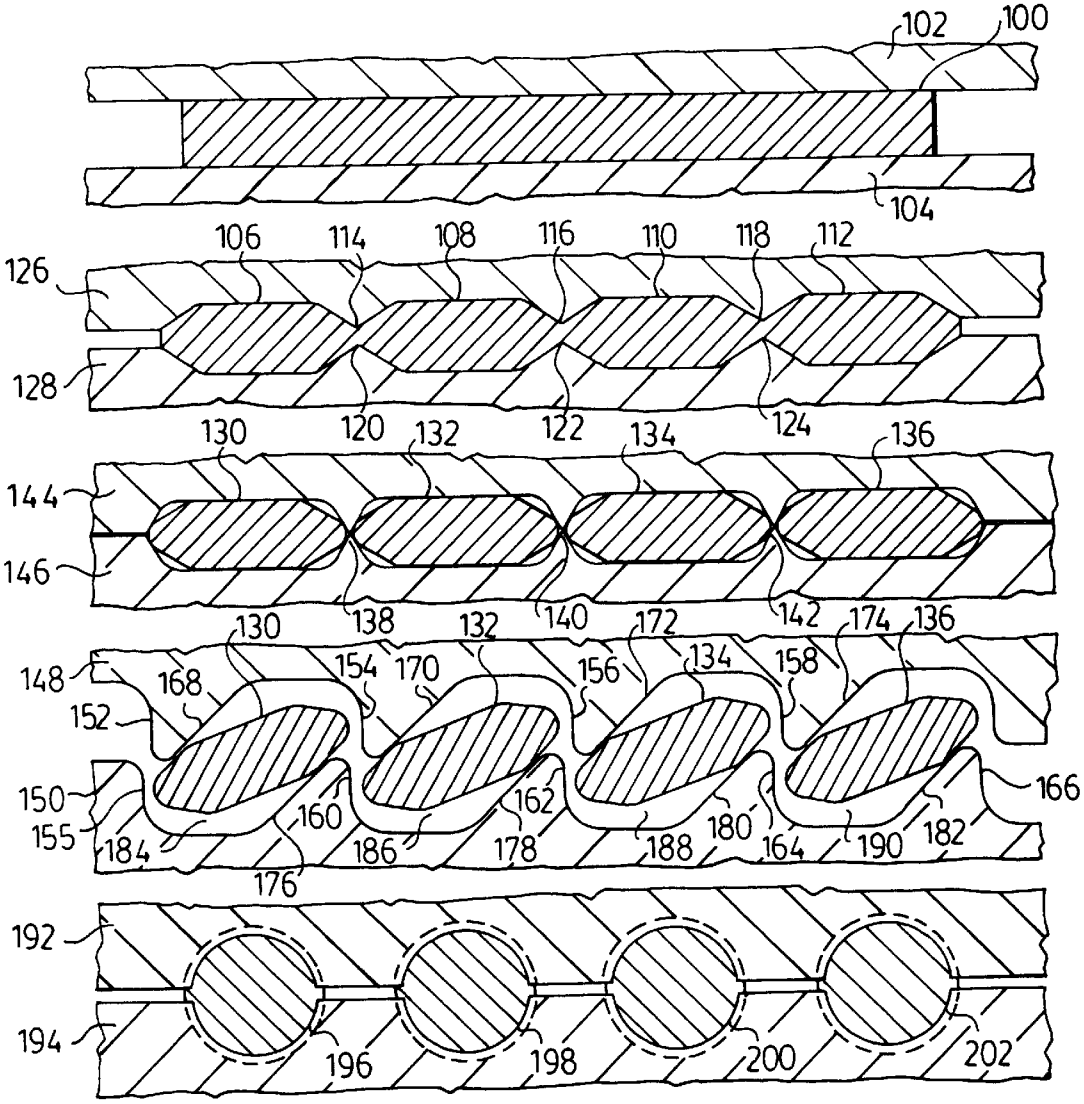
FIG. 2 shows the rolling sequence of this invention which is used to produce a plurality of sections of circular cross section from a flat slab produced from the original billet.

FIG. 2 shows the preferred process for producing four sections from a rectangularly shaped bar 100 having a height to width dimensional ratio of about 1:3 for each separated section produced. For instance, to produce 4 strands, the ratio will be 1 to 11 or 12. Bar 100 is shown having just exited from the eleventh millstand having been reduced by rollers 102 and 104. The width to height ratio of bar 100 is about 11:1. Bar 100 comprises a standard shape which is relatively easy to roll and no exit guide is required for the bar 100 leaving the eleventh mill stand.

At the twelfth millstand, bar 100 is grooved to produce four sections 106, 108, 110 and 112 separated by depressions 114, 116, 118, 120, 122 and 124. These depressions are produced by rollers 126 and 128 which captivate the bar 100 in the gapped openings formed therein. The formation of channels 114 through 124 does not produce any significant exit velocity differentials between the sections 106, 108, 110 and 112 so the grooved bar 100 tends to exit from the twelfth millstand in a straight line and thus the tendency for the channeled billet 100 to curve or separate the adjoining sections upon exiting from millstand 12 is virtually non existent.

The channeled billet 100 is passed from the twelfth millstand and into the thirteenth millstand where a plurality of sections 130, 132, 134 and 136 of elongated oval shaped cross section are produced. Each of the above sections is connected to its adjacent section by webs 138, 140 and 142 which are very narrow. This configuration of sections 130–136 is produced by rollers 144 and 146 which have mating protruding rings which co-operate to form the four still joined sections 130–136.

The production of sections 130–136 is very important for a number of reasons. The particular flow of the hot metal product to produce the four sections 130–136 is produced with a minimum of rolling energy. The flow of metal in each section is much the same for each section (i.e. from the edges of the oval shaped section toward the center) and also simultaneously in the direction of rolling. This flow does not cause wide variations in the exit velocities of the sections 130–136 so that the joined sections of the billet 100 do not tend to separate prematurely. Curvature of the complete channeled billet 100 tends to be minimized, thus the need for exit guides at this stage of rolling is really not necessary.

The segmented but still joined billet 100 is passed from the thirteenth millstand to the fourteenth millstand where a four roll entry guide will generally be used to guide the channelled billet 100 into the fourteenth millstand. At the fourteenth millstand, a pair of rollers 148 and 150 whose surface profile has a "sawtooth" shape now engages the nearly separated sections 130, 132, 134 and 136. Rollers 148 and 150 are provided with a series of ramped teeth 152, 154, 156, 158 and 160, 162, 164 and 166 respectively. Each of the above teeth has adjoining sloping surfaces 168, 170, 172, 174 and 176, 178, 180 and 182 formed integrally therewith. Rolls 148 and 150 offset so that the sloping surfaces such as 168 and 176 co-operate to engage and twist section 130 counter clockwise. Simultaneously, the surfaces 170 and 178 of rolls 148 and 150 respectively engage and twist section 132 in a counter clockwise direction during passage therebetween. Sections 130 and 132 now separate as do the other sections 134 and 136.

Rollers 148 and 150 are situated so that the two "sawtooth" surface profiles are mated together, to form parallelogramically shaped recesses 184, 186, 188 and 190 between them.

The recess 184 is formed of sloping sides 168 and 176 and straight sides 154 and 155.

It must be remembered that the sawtooth profile of rollers 148 and 150 are actually protruding rings of a frustro-conical configuration on each of the rollers which must be provided by a grinding operation. The rollers have cylindrical surfaces separating the frustro-conical rings. These profiles are not difficult to produce in practise.

It is the positioning of the rolls to produce the parallelogramically shaped recess between the rolls 148 and 150 which leads to the efficient separation of the sections 130, 132, 134 and 136. For instance, the two sloping surfaces 168 and 170 of rolls 148 and 150 respectively which form part of recess 184 gradually separates the sections 130 and 132 during passage through the fourteenth millstand and leave each section such as 130 slightly twisted as it exits the fourteenth millstand.

Each of the oval shaped sections 130–136 is allowed to twist through a right angle as it exits the fourteenth millstand in the absence of any guides. The sections 130–136 are fed to the fifteenth millstand having rollers 192 and 194. Rolls 192 and 194 are provided with four circular caliber openings 196, 198, 200 and 202. Sections 130–136 have now obtained a circular cross section.

The slitting operation is precise and accurate with each separated section being slit without any substantial deformation having been undergone by each section during the slitting operation. This assures that each section emerges from the slitter with the same twist and exit velocity. Problems with loop control and curving of the workpiece is avoided.

It will be noted, that the separation of the strands is achieved without having premature strand separation or adverse material flow.

This process requires the presence of no "twister" or "straightening" guides. Most guides, which will be used, are stranded multi roller entry guide types.

This invention may be used to produce a wide variety of the number of separated strands of the steel work produce.

What is claimed is:

1. A method of separating a steel bar into a series of separated sections comprising:

subjecting said steel bar to a rolling operation to form a series of spaced opposing parallel grooves in said bar to produce a plurality of elements of elongated cross sectional shape, such that each element remains joined to the adjacent element at each groove by a narrow web, each element having an upper and lower surface, and passing said bar so grooved between a pair of cooperating non interlocking rolls, each having a series of spaced projecting rings formed on each roll to contact said upper and lower surfaces of each element at predetermined locations to produce a slight twist in each element as it passes between said cooperating rolls so that each element twists in the same angular direction so as to fracture each narrow web, and producing a plurality of separated elements.

2. A method as claimed in claim 1 wherein said projecting rings of said non interlocking rolls are conically shaped.

3. A steel rolling mill comprising a plurality of millstands for separating a hot steel bar into a plurality of separate strands by slitting comprising:

a first millstand having a pair of opposed rollers for producing opposed grooves in the upper and lower surfaces of said bar to divide said bar into a series of joined strands which are attached to each other by a web existing between said opposed grooves, a second millstand having a pair of opposed rollers having a gap profile to deepen said grooves to narrow said web and shape said sections into elongated oval shaped cross sections, a third millstand having a pair of opposed non interlocking rollers having a predetermined gap profile which forms a plurality of spaced cavities between said rollers, each cavity so formed defining an area substantially greater than the cross section of each strand, said gap profile causing said strands of said bar to be twisted in the same direction of rotation and separate each strand at each deepened groove.

4. A method of separating a hot steel bar into a plurality of parallel sections comprising:

providing a hot steel bar of predetermined temperature and dimensions to a first millstand for forming a plurality of parallel opposing grooves in the upper and lower surfaces thereof;

providing a second millstand for deepening said grooves in said bar whilst simultaneously forming said sections into elongated oval shapes;

providing a third millstand having a pair of non interlocking rollers therein having a predetermined profile to contact said steel bar at two diametrically opposed locations on each section and produce a slight angular twist in each section of said bar as it passes therebetween, each section being twisted in the same angular direction to separate said elongated oval sections;

providing a fourth millstand to shape said plurality of elongated oval sections into a desired shape.

5. A millstand for slitting a steel bar having a predetermined configuration comprising a pair of non interlocking rollers each having a predetermined roller shape in the form of an elongated cylinder having a series of evenly spaced substantially similar conically shaped rings protruding from said cylindrical surface, said rollers being mounted in said millstand so as to form a caliber which forms a series of spaced identical parallegramically shaped cavities between said pair of rollers.

* * * * *